US006917771B2

(12) United States Patent
Shim et al.

(10) Patent No.: US 6,917,771 B2
(45) Date of Patent: Jul. 12, 2005

(54) DUPLEX ELECTRO-PHOTOGRAPHIC DEVELOPING MACHINE AND METHOD OF CONTROLLING TONER IMAGE CONCENTRATION THEREOF

(75) Inventors: Woo-Jung Shim, Suwon (KR); Cheol-Ju Yang, Daegu (KR); Min-seon Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/657,073

(22) Filed: Sep. 9, 2003

(65) Prior Publication Data

US 2004/0052539 A1 Mar. 18, 2004

(30) Foreign Application Priority Data

Sep. 12, 2002 (KR) ..... 10-2002-0055479

(51) Int. Cl.[7] ..... G03G 15/00; G03G 15/10

(52) U.S. Cl. ..... 399/45; 399/44; 399/55; 399/58

(58) Field of Search ..... 399/43, 44, 45, 399/46, 49, 50, 53, 55, 94, 97, 66, 58

(56) References Cited

U.S. PATENT DOCUMENTS 5,966,557 A * 10/1999 Wada ..... 399/43
6,047,144 A * 4/2000 Sasai et al. ..... 399/44

* cited by examiner

*Primary Examiner*—Hoang Ngo
(74) *Attorney, Agent, or Firm*—Staas & Halsey LLP

(57) ABSTRACT

A duplex electro-photographic developing machine including a printing medium tray loading a printing medium, a tray open/closed detecting unit detecting whether the printing medium tray has been opened and closed, a transferring roller transferring a toner image onto the printing medium, a resistance measuring unit measuring a resistance value of the printing medium passing the transferring roller, and a concentration controlling unit controlling a concentration of the toner image according to the measured resistance value measured by the resistance measuring unit in response to the printing medium tray having changed from an open state to a close state.

27 Claims, 5 Drawing Sheets

DUPLEX ELECTRO-PHOTOGRAPHIC DEVELOPING MACHINE AND METHOD OF CONTROLLING TONER IMAGE CONCENTRATION THEREOF

CROSS-REFERENCE TO RELATED APPLICATIONS

This application claims the benefit of Korean Application No. 2002-55479, filed Sep. 12, 2002, in the Korean Intellectual Property Office, the disclosure of which is incorporated herein by reference.

BACKGROUND OF THE INVENTION

1. Field of the Invention

The present invention relates to a paper resistance detecting apparatus of an electro-photographic developing machine, and, more particularly, to a paper resistance detecting apparatus of a duplex electro-photographic developing machine for detecting a resistance of a sheet of paper and accordingly controlling a concentration of toner image to a desired degree, and a method thereof.

2. Description of the Related Art

Generally, an electro-photographic developing machine is a complex OA (office appliance) apparatus that includes the functions of a duplicator, a printer, a facsimile, etc. For the electro-photographic developing machine, a photosensitive medium such as a photosensitive belt or a photosensitive drum is used. A surface of a such photosensitive medium is charged by a charged voltage controlling device. Further, a level of electric potential is selectively changed by the scanning of a beam, and thus an electrostatic latent image is formed on the surface of the photosensitive medium. The electrostatic latent image formed on the surface of the photosensitive medium has a different concentration according to a humidity of the paper sheet.

FIG. 1 is a schematic view of a conventional electro-photographic developing machine.

Referring to FIG. 1, the electro-photographic developing machine comprises a printing medium tray 11, a pickup roller 13, a feeding roller 15, a photosensitive belt 17, a transferring roller 19, and a fixing roller 21.

The printing medium tray 11 is disposed at a desired position of the electro-photographic developing machine to load various kinds of printing media therein. The printing media are picked up by the pickup roller 13 according to their kinds, such as copying machine paper, bond paper, special application paper, recycled paper, transparent paper, etc. The printing medium is then guided by a printing medium guide (not shown) and a printing medium guide roller (not shown) toward a feeding position. The feeding roller 15 transports the printing medium to a space between the transferring roller 19 and the fixing roller 21 at a predetermined speed.

Meanwhile, a surface of the photosensitive belt 17 is maintained in a charged state by a corona device or a charging device, etc. Further, on the surface of the photosensitive belt 17, there is formed an electrostatic latent image by the scanning beam of a laser scanning device (not shown). The developing machine 23 attaches colors of black, yellow, cyan, and magenta, provided according to the colors of the respective pigments, onto the electrostatic latent image, and thus forms a toner image. The toner image formed on the photosensitive belt 17 is transferred by the transferring roller 19 onto the printing medium moving between the transferring roller 19 and the fixing roller 21.

Herein, the electro-photographic developing machine measures a resistance of the printing medium moving between the transferring roller 19 and the fixing roller 21, and changes a concentration of the toner image transferred to the printing medium according to the measured resistance value.

However, in the conventional electro-photographic developing machine, and especially in a duplex electro-photographic developing machine, because a resistance value of the transferred toner image is added to a resistance value of the printing medium, the resistance value at a front face of the printing medium may be different from that at a rear face of the printing medium. Therefore, it becomes impossible to properly control the concentration of the toner image with respect to the change of the humidity of the printing medium according to the environmental change. Furthermore, in the case that a front face printing and a rear face printing of the printing medium are repeated, since the measured resistance value is continuously changed, the change of the concentration to be controlled is also repeated, and the continuous repetition of the controlling value may cause the electro-photographic developing machine to malfunction. Since the controlling operation of the concentration of the toner image is performed only by the measuring of the printing medium passing between the transferring roller 19 and the fixing roller 21, if the same printing media are supplied under the same temperature and humidity, the possibility of the above problems with the electro-photographic developing machine is too high.

SUMMARY OF THE INVENTION

Therefore, it is an aspect of the present invention to provide an electro-photographic developing machine, and a method thereof, which measures a substantial resistance value of a printing medium and properly control a concentration of a toner image according to the measured resistance value.

Additional aspects and/or advantages of the invention will be set forth in part in the description which follows and, in part, will be obvious from the description, or may be learned by practice of the invention.

In order to accomplish the above aspects and/or other advantages of the present invention, a duplex electro-photographic developing machine includes a printing medium tray loading a printing medium, a tray open/closed detecting unit detecting whether the printing medium tray has been opened and closed, a transferring roller transferring a toner image onto the printing medium, a resistance measuring unit measuring a resistance value of the printing medium passing the transferring roller, and a concentration controlling unit controlling a concentration of the toner image transferred to the printing medium according to the measured resistance value. The concentration controlling unit controls the concentration of the toner image according to the resistance value measured by the resistance measuring unit in response to the printing medium tray having changed from an open state to a closed state. The printing medium of the measured resistance value may be transferred to a duplex printing path in response to the printing medium tray changing from an open state to a closed state.

A power supply detecting unit detecting whether power is supplied to the duplex electro-photographic developing machine may be provided, wherein the concentration controlling unit controls the concentration of the toner image according to the resistance value measured by the resistance measuring unit when the detected power changes from an off-state to an on-state.

A toner image forming unit forming the toner image on a photosensitive body may be provided, wherein the concentration controlling unit controls the concentration of the toner image formed by the toner image forming unit.

A high voltage power supplier supplying a high voltage to the transferring roller may be provided, wherein the concentration controlling unit controls the concentration of the toner image transferred to the printing medium by changing the high voltage supplied by the high voltage power supplier.

The concentration controlling unit may control the high voltage power supplier so that the toner image is transferred by a preset high voltage in response to the toner image being transferred to another surface of the printing medium.

According to an embodiment of the present invention, there is provided a method of controlling a concentration of a toner image of a duplex electro-photographic developing machine, including detecting whether the printing medium tray with the printing medium being loaded therein has been opened and closed, measuring a resistance value of the printing medium passing a transferring roller, and controlling the concentration of the toner image transferred to the printing medium according to the measured resistance value of the printing medium. The resistance value of the printing medium is measured in response to the printing medium tray changing from an open state to a closed state.

Therefore, in the duplex electro-photographic developing machine of an embodiment of the present invention, the resistance value of the toner image is added to the resistance value of the printing medium, thereby preventing erroneous controlling of the concentration of the toner image, and also preventing a malfunction of the duplex electro-photographic developing machine.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
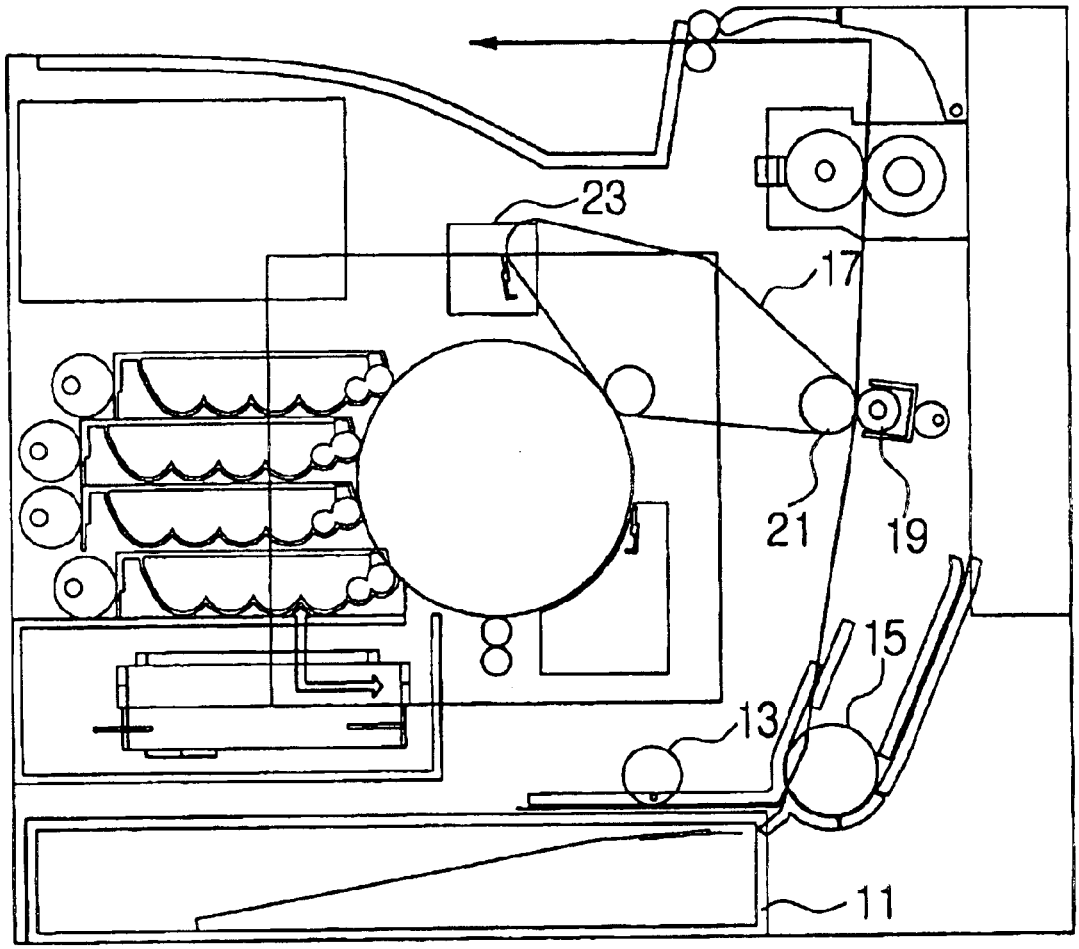
FIG. 1 (PRIOR ART)
FIG. 1 is a schematic view of a conventional electro-photographic developing machine.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
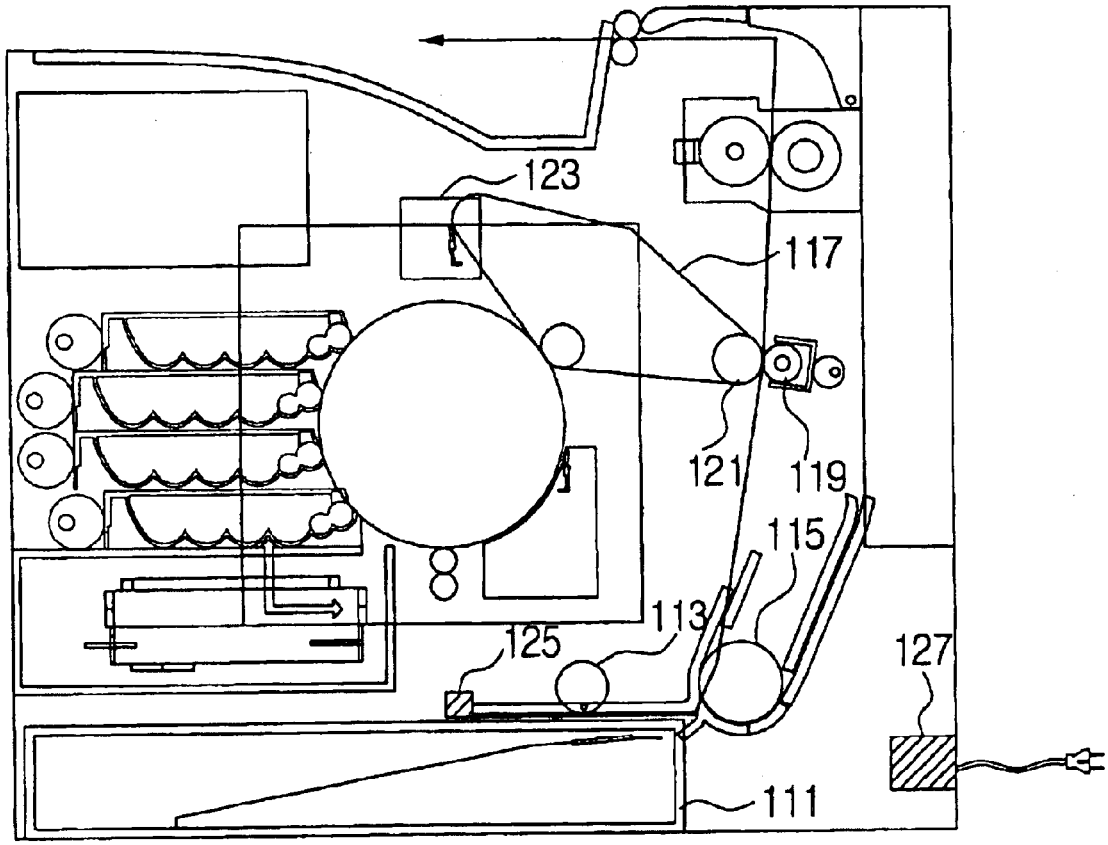
FIG. 2 is a schematic view of a duplex electro-photographic developing machine according to an embodiment of the present invention.

FIG. 2 is a schematic view of a duplex electro-photographic developing machine according to an embodiment of the present invention. Referring to FIG. 2, the duplex electro-photographic developing machine comprises a printing medium tray 111, a pickup roller 113, a feeding roller 115, a photosensitive belt 117, a transferring roller 119, a fixing roller 121, a toner image forming unit 123, a tray open/closed detecting unit 125 and a power supply detecting unit 127.

The printing medium tray 111 is disposed at a desired position of the electro-photographic developing machine, and loads printing media by their kind. The loaded printing medium is picked up by the pickup roller 113 according to the kind of the printing medium, such as copy machine paper, bond paper, specific application paper, recycled paper, transparent paper, etc. The picked-up printing medium is guided by a printing medium guide (not shown) and a printing medium guide roller (not shown) and transferred to a feeding position. The feeding roller 115 transfers the printing medium to a space between the transferring roller 119 and the fixing roller 121.

Meanwhile, a surface of the photosensitive belt 117 is maintained in a charged state by a corona device or a charging device, etc. Further, on the surface of the photosensitive belt 117, there is formed an electrostatic latent image by a scanning beam of a laser scanning device (not shown). The developing machine 123 attaches colors of black, yellow, cyan, and magenta, provided according to the colors of the pigments onto the electrostatic latent image, and forms a toner image. The toner image formed on the photosensitive belt 117 is transferred by the transferring roller 119 to the printing medium moving between the transferring roller 119 and the fixing roller 121.

Herein, the electro-photographic developing machine measures a resistance of the printing medium moving between the transferring roller 119 and the fixing roller 121, and changes a concentration of the toner image transferred to the printing medium according to the measured resistance value.

Figure 3:
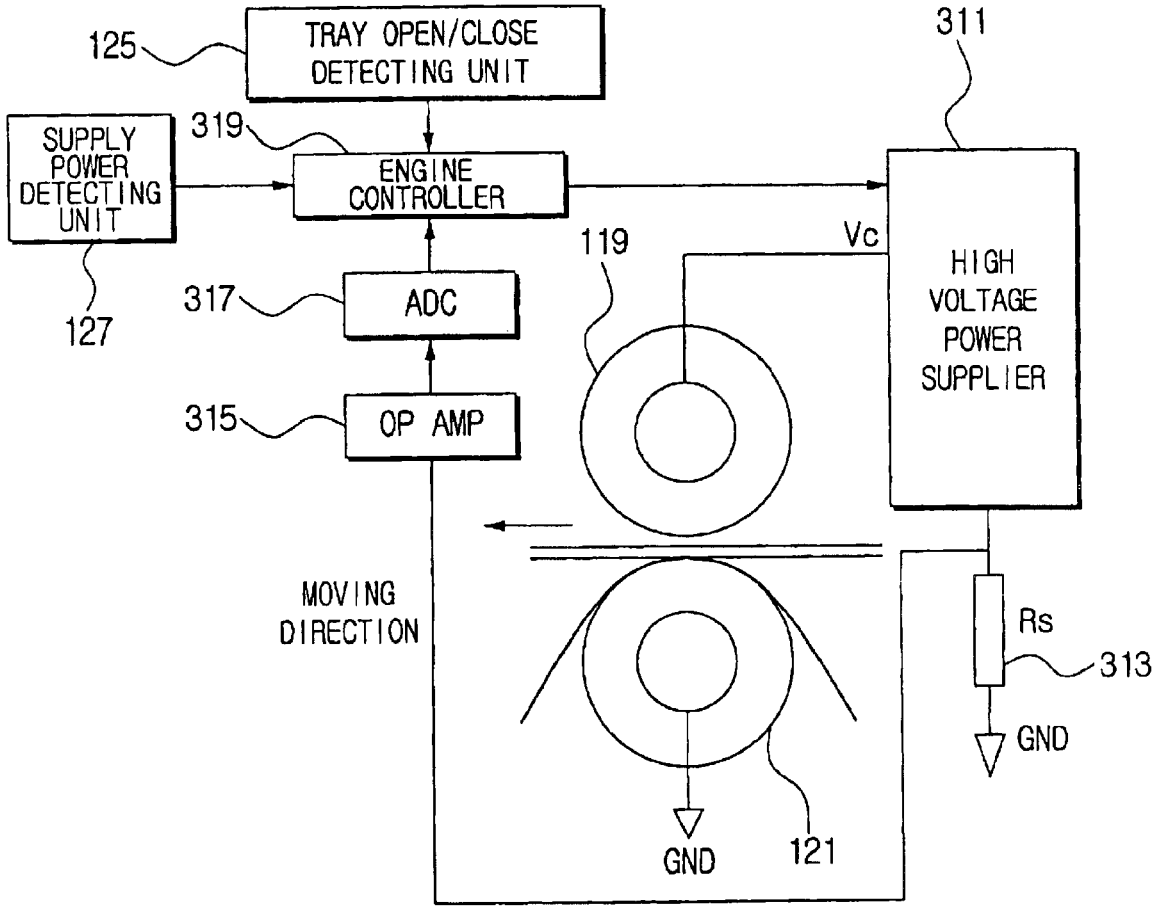
FIG. 3 is a schematic view of a transfer voltage controlling device of FIG. 2.

FIG. 3 is a schematic view of a transfer voltage controlling device of FIG. 2. Referring to FIG. 3, the duplex electro-photographic developing machine comprises a high voltage power supplier 311 connected to a metal shaft of the transferring roller 119 to supply a high voltage, a sensing resistor 313 connected to the high voltage power supplier 311 to detect a transfer current supplied to the transferring roller 119, an amplifier 315 amplifying the detected current, an AD converter 317 converting the amplified current into a digital value, an engine controller 319 calculating a resistance value of the printing medium based on the digitalized current value, and controlling a voltage from the high voltage power supplier 311 according to the calculated resistance value, and a tray open/closed detecting sensor 125 detecting whether a tray has been open and closed, and then transmitting a detected result to the engine controller 319.

If a high voltage is applied from the high voltage power supplier 311 to the transferring roller 119, the engine controller 319 calculates the transfer current supplied to the transferring roller 119 on the basis of the current value detected by the sensing resistor 313. Herein, the engine controller 319 calculates a resistance value of the transferring roller 119 and the fixing roller 121, on the basis of the transfer current, in a case that the printing medium is not introduced between the transfer roller 119 and the fixing roller 121. Further, the engine controller 319 calculates a resistance value, on the basis of the transfer current, in a case that the printing medium is introduced between the transfer roller 119 and the fixing roller 121. The engine controller 319 compares the two calculated resistance values and calculates the resistance value of the printing medium supplied between the transfer roller 119 and the fixing roller 121.

Figure 4:
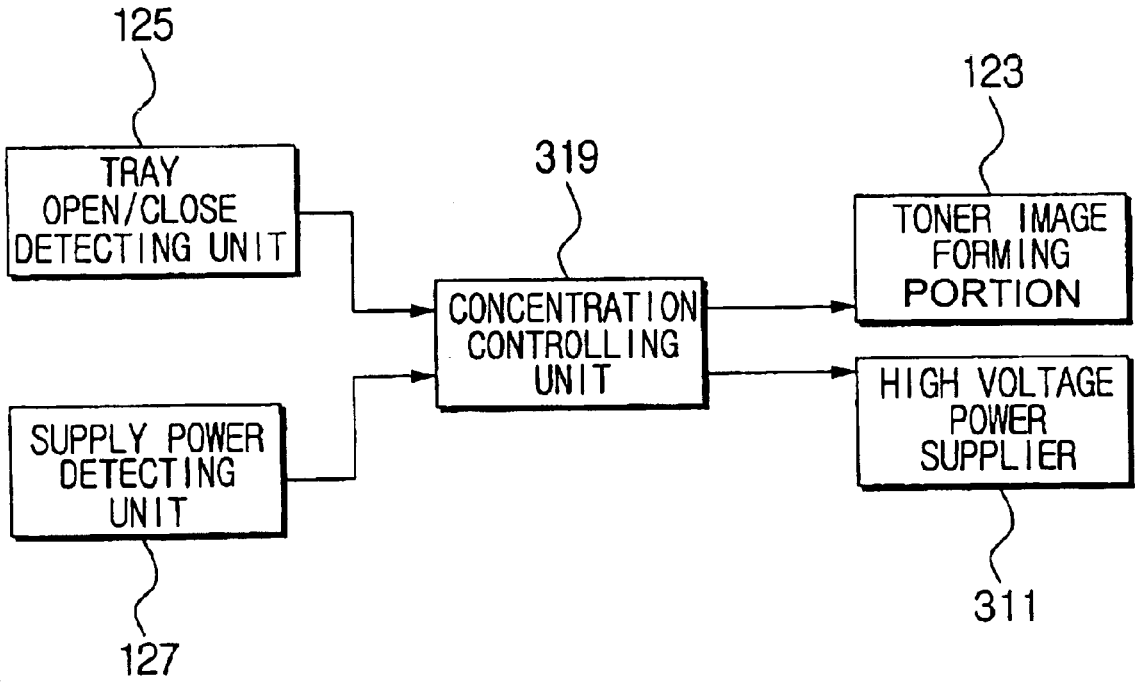
FIG. 4 is a block diagram showing a method of controlling a concentration of a toner image of FIG. 2.
Figure 5:
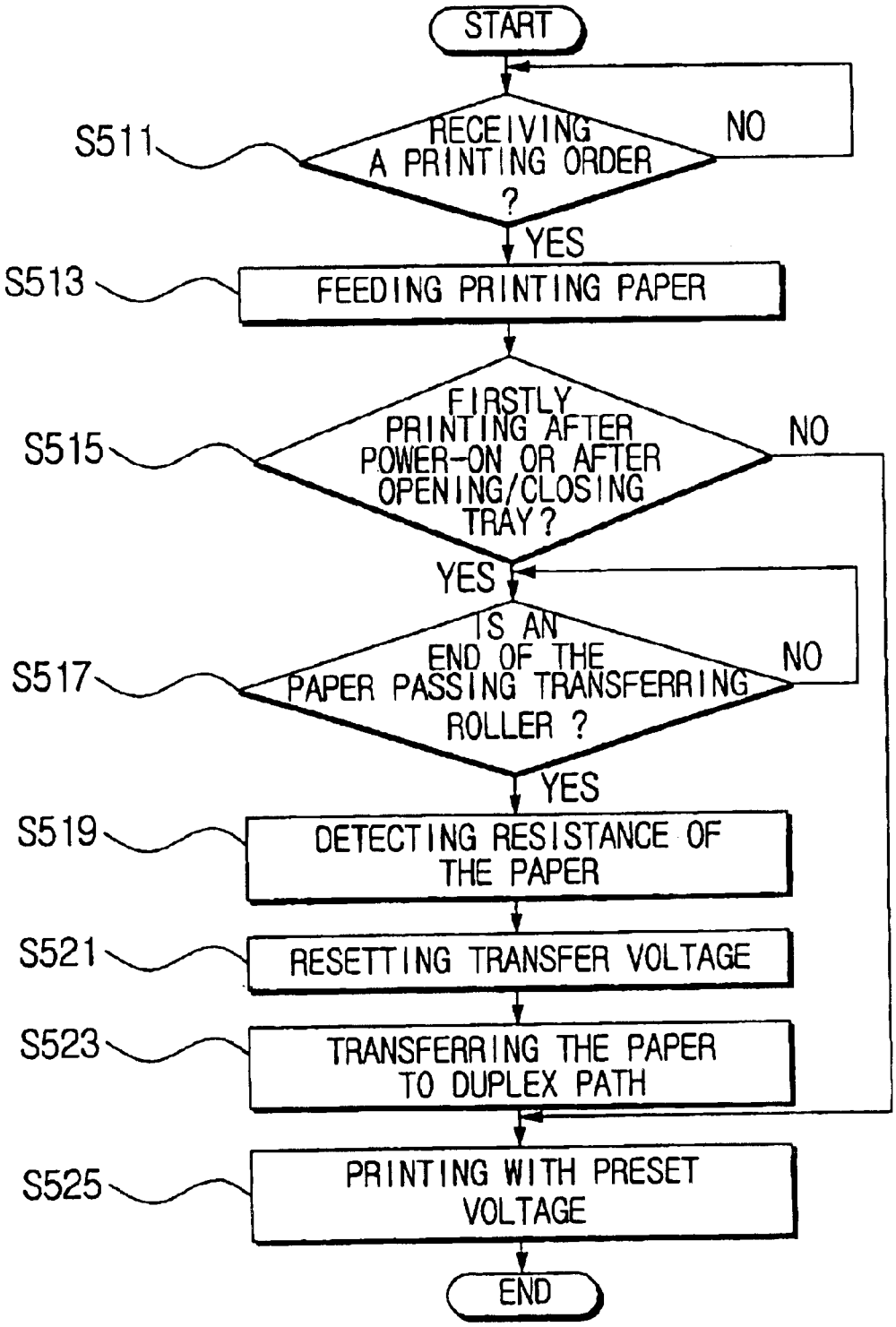
FIG. 5 is a flow chart showing the method of controlling a concentration of a toner image of FIG. 2.

The tray open/closed detecting sensor 125 and the supply power detecting sensor 127 are connected to the engine controller 319. The engine controller 319 controls the voltage of the high voltage power supplier 311 according to data respectively from the tray open/closed detecting sensor 125 and the supply power detecting sensor 127, and the calculated resistance value of the printing medium, and thus controls the concentration of the toner image transferred to the printing medium. Referring to FIGS. 4 and 5, a method of controlling the concentration of the toner image by the engine controller 319 will be fully described.

FIG. 4 is a block diagram showing a method of controlling a concentration of a toner image of FIG. 2, and FIG. 5 is a flow chart showing the method of controlling a concentration of a toner image of FIG. 2, wherein the engine controller 319 will be referred as a concentration controlling unit 319 for convenience's sake.

If an electro-photographic developing order is input to the duplex electro-photographic developing machine (S511), the pickup roller 113 picks up the printing medium from the printing medium tray 111, and then transfers the picked-up printing medium to the feeding roller 115. The feeding roller 115 transfers again the printing medium transferred from the pickup roller 113 to a space between the transferring roller 119 and the fixing roller 121 (S513). At this time, the tray open/closed detecting unit 125 detects whether the printing medium tray 111, in which the printing medium is loaded, has been open and closed. Preferably, the tray open/closed detecting unit 125 is provided to each printing medium tray which loads the printing medium in a status that the printing media are classified by their kind.

The tray open/closed detecting unit 125 transmits the detected result to the concentration controlling unit 319. In this case, a timing for transmitting the result detected by the tray open/closed detecting unit 125 to the concentration controlling unit 319 is set such that the result is transmitted whenever the electro-photographic developing order is received or the printing medium is picked up by the pickup roller 113, or the result is periodically transmitted at a desired time period.

The concentration controlling unit 319 determines, on the basis of the result received from the tray open/closed detecting unit 125, whether the printing medium tray 111 has changed from an open state to a closed state (S515). In the case that the printing medium tray 111 has changed from the open state to the closed state, the concentration controlling unit 319 determines that a new printing medium in a different environment is supplied. Herein, the different environment means that a temperature and humidity state of the printing medium located outside of the printing medium tray 111 is different from that of the printing medium located in the printing medium tray 111.

Meanwhile, the power supply detecting unit 127 detects whether the power is supplied to the duplex electro-photographic developing machine. A detected result is transmitted to the concentration controlling unit 319. A timing for transmitting the result detected by the supply power detecting unit 127 to the concentration controlling unit 319 is set such that the result is transmitted whenever the electro-photographic developing order is received or the printing medium is picked up by the pickup roller 113, or the result is periodically transmitted at a desired time period.

The concentration controlling unit 319 determines, on the basis of the result from the supply power detecting unit 127, whether a power state supplied to the duplex electro-photographic developing machine has changed from an off-state to an on-state (S515). If it is determined that the power state has changed from the off-state to the on-state, the concentration controlling unit 319 determines that the environment of the printing medium loaded in the printing medium has changed, i.e., in the case that the printing medium loaded in the printing medium tray is not used for a long time, the environment of the printing medium may be changed.

If the printing medium is transferred by the feeding roller 115 to the space between the transferring roller 119 and the fixing roller 121, the concentration controlling unit 319 determines whether a distal end of the printing medium is passing the transferring roller 119 (S517). If the printing medium is passing the transferring roller 119, the concentration controlling unit 319 calculates the resistance value of the printing medium (S519).

The concentration controlling unit 319 controls the high voltage output from the high voltage power supplier 311 according to the calculated resistance value of the printing medium (S521). In this case, the proper voltage value corresponding to the resistance value of the printing medium is stored in the form of a look-up table. Preferably, the concentration controlling unit 319 retrieves the stored look-up table, and controls the high voltage output from the high voltage power supplier 311 according to the retrieved result.

In addition, the concentration controlling unit 319 controls the developing machine 123, thereby controlling the concentration of the toner image formed on the photosensitive belt 117. Herein, in order to directly control the concentration of the toner image formed on the photosensitive belt 117, a concentration of a color of black, yellow, cyan, and magenta is directly controlled.

Meanwhile, the printing medium of the measured resistance value is transferred to a duplex printing path (S523) in the case that the printing medium tray 111 changes from the open state to the closed state, or that the duplex electro-photographic developing machine changes from the off-state to the on-state. Because the printing medium of the measured resistance value is used, wastage of the printing medium is avoided.

Furthermore, in the case that the toner image is transferred to the continuously supplied printing medium in a status that the printing medium tray 111 has remained closed, or the toner image is transferred to a rear surface of the printing medium of which a front surface is already printed, the concentration controlling unit 319 controls the high voltage power supplier 311 so that the toner image is transferred by a preset voltage. In this case, the concentration controlling unit 319 determines that the environment of the printing medium is not changed.

Therefore, the duplex electro-photographic developing machine of an embodiment of the present invention properly controls the concentration of the toner image according to the kind of the printing medium and the substantial environment change.

According to the duplex electro-photographic developing machine of an embodiment of the present invention, the inadequately performed controlling of the concentration of the toner image due to an erroneous measurement of the resistance value of the printing medium is prevented, and also the malfunction of the developing machine due to the repetitive measurement of the resistance value of the printing medium is prevented.

Further, according to an embodiment of the present invention, the duplex electro-photographic developing machine more precisely controls the concentration of the toner image according to the kind of the printing medium and the substantial environment change.

Alternately, the operations controlling the electro-photographic device could be implemented by permanent or removable digital storage, such as magnetic and optical discs, RAM, ROM, etc., on which the operations and data structures of the present invention can be stored and distributed. The operations can also be distributed via, for example, downloading over a network such as the Internet.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A duplex electro-photographic developing machine, comprising:

a printing medium tray loading a printing medium;

a tray open/closed detecting unit detecting whether the printing medium tray has been opened and closed;

a transferring roller transferring a toner image onto the printing medium;

a resistance measuring unit measuring a resistance value of the printing medium passing the transferring roller; and a concentration controlling unit controlling a concentration of the toner image transferred to the printing medium according to the measured resistance value, wherein the concentration controlling unit controls the concentration of the toner image according to the resistance value measured by the resistance measuring unit in response to the printing medium tray having changed from an open state to a closed state, and wherein the printing medium of the measured resistance value is transferred to a duplex printing path in response to the printing medium tray changing from an open state to a closed state.

2. The developing machine of claim 1, further comprising a fixing roller, wherein the resistance value of the printing medium is measured as the printing medium moves between the fixing roller and the transferring roller.

3. The developing machine of claim 2, wherein the resistance measuring unit measures the resistance value by comparing a first resistance of the transferring roller and the fixing roller without the printing medium therebetween with a second resistance of the transferring roller and the fixing roller with the printing medium therebetween.

4. The developing machine of claim 1, further comprising a power supply detecting unit detecting whether power is supplied to the duplex electro-photographic developing machine, wherein the concentration controlling unit controls the concentration of the toner image according to the resistance value measured by the resistance measuring unit when the detected power changes from an off-state to an on-state.

5. The developing machine of claim 4, further comprising:

a photosensitive body; and a toner image forming unit forming the toner image on the photosensitive body;

wherein the concentration controlling unit controls the concentration of the toner image formed by the toner image forming unit.

6. The developing machine of claim 5, further comprising a high voltage power supplier supplying a high voltage to the transferring roller, wherein the concentration controlling unit controls the concentration of the toner image transferred to the printing medium by changing the high voltage supplied by the high voltage power supplier.

7. The developing machine of claim 6, wherein the transferring roller further comprises a metal shaft, and the high voltage power supplier is coupled to the metal shaft of the transferring roller.

8. The developing machine of claim 7, further comprising a sensing resistor, wherein the sensing resistor is coupled to the high voltage power supplier to detect a transfer current supplied to the transferring roller.

9. The developing machine of claim 8, further comprising an amplifier amplifying the detected transfer current.

10. The developing machine of claim 9, further comprising an A/D converter converting the amplified current into a digital value.

11. The developing machine of claim 10, wherein the resistance measuring unit measures the resistance value of the printing medium based on the digital value.

12. The developing machine of claim 6, wherein the concentration controlling unit controls the high voltage power supplier so that the toner image is transferred by a preset high voltage in response to the toner image being transferred to another surface of the printing medium.

13. The developing machine of claim 6, wherein the concentration controlling unit retrieves a stored look-up table, and controls the high voltage supplied by the high voltage power supplier according to a result in the stored look-up table that corresponds to the measured resistance value of the printing medium.

14. The developing machine of claim 1, further comprising a plurality of printing medium trays, wherein there are a plural number of the tray open/closed detecting units respectively provided to each of the plurality of printing medium trays.

15. The developing machine of claim 1, wherein a signal from the tray open/closed detecting unit is transmitted each time an electro-photographic developing order is received.

16. The developing machine of claim 1, wherein a signal from the tray open/closed detecting unit is transmitted periodically at a predetermined time period.

17. A method of controlling a concentration of a toner image of a duplex electro-photographic developing machine, comprising:

detecting whether a printing medium tray, with a printing medium being loaded therein, has been opened and closed;

measuring a resistance value of the printing medium passing a transferring roller;

controlling the concentration of the toner image transferred to the printing medium according to the measured resistance value of the printing medium, wherein the resistance value of the printing medium is measured in response to the printing medium tray changing from an open state to a closed state; and transferring the printing medium of the measured resistance value to a duplex printing path in response to the printing medium tray changing from the open state to the closed state.

18. The method of claim 17, further comprising detecting whether power is supplied to the duplex electro-photographic developing machine, wherein the concentration of the toner image is controlled according to the resistance value measured in response to the power supplying state changing from an off-state to an on-state.

19. The method of claim 18, further comprising forming the toner image on a photosensitive body, wherein the concentration of the toner image is controlled according to the measured resistance value of the printing medium.

20. The method of claim 19, wherein the concentration of the toner image transferred to the printing medium is controlled by changing the voltage supplied to the transferring roller.

21. The method of claim 20, wherein the toner image is transferred by a preset voltage in response to the toner image being transferred to another surface of the printing medium.

22. The method of claim 21, wherein the toner image is transferred by the preset voltage in response to the toner image being transferred to the continuously supplied printing medium after the printing medium tray is closed.

23. The method of claim 20, wherein the voltage supplied to the transferring roller is determined according to a result in a stored look-up table that corresponds to the measured resistance value of the printing medium.

24. An electro-photographic developing machine, comprising:

a printing medium tray;

a tray open/closed detecting unit detecting whether the printing medium tray has been opened and closed; and a controlling unit;

wherein the controlling unit determines a resistance value of a printing medium in response to the tray having been opened and closed, and controls a concentration of toner image applied to the printing medium according to the resistance value, and wherein the printing medium of the resistance value is transferred to a duplex printing path in response to the printing medium tray changing from an open state to a closed state.

25. The electro-photographic developing machine of claim 24, further comprising:

a power supply detecting unit detecting whether the power supply stopped and restarted;

wherein the controlling unit determines the resistance value of the printing medium in response to the power supply having been stopped and restarted, and controls the concentration of toner image applied to the printing medium according to the resistance value.

26. A machine readable storage medium controlling an electro-photographic printer, wherein the controlling comprises:

determining whether a printing medium tray has been opened and closed;

determining a resistance value of a printing medium in response to the tray having been opened and closed;

controlling a concentration of toner image applied to the printing medium according to the resistance value; and transferring the printing medium of the resistance value to a duplex printing path in response to the printing medium tray changing from an open state to a closed state.

27. The machine readable storage medium of claim 26, wherein the controlling further comprises:

determining whether a power supply to the electro-photographic printer has been stopped and restarted;

determining the resistance value of the printing medium in response to the power supply having been stopped and restarted;

and controlling the concentration of toner image applied to the printing medium according to the resistance value.

* * * * *